US005195490A

United States Patent [19]

Maier

[11] Patent Number: 5,195,490

[45] Date of Patent: Mar. 23, 1993

[54] SPEED GOVERNOR FOR FUEL INJECTION PUMPS OF INTERNAL COMBUSTION ENGINES

[75] Inventor: Sieghart Maier, Gerlingen, Fed. Rep. of Germany

[73] Assignee: Robert Bosch GmbH, Stuttgart, Fed. Rep. of Germany

[21] Appl. No.: 910,921

[22] Filed: Jul. 9, 1992

[30] Foreign Application Priority Data

Sep. 7, 1991 [DE] Fed. Rep. of Germany ..... 4129837

[51] Int. Cl.[5] ..... F02D 31/00

[52] U.S. Cl. ..... 123/373; 123/365

[58] Field of Search ..... 123/372, 373, 374, 364, 123/365, 368

[56] References Cited

U.S. PATENT DOCUMENTS

| | | | |
|---|---|---|---|
| 2,986,291 | 5/1961 | Schick | 123/373 |
| 3,924,594 | 12/1975 | Aoki | 123/373 |
| 4,305,363 | 12/1981 | Yanagi | 123/373 |
| 4,384,562 | 5/1983 | Hammock | 123/179.17 |
| 4,409,941 | 10/1983 | Haubenhofer | 123/373 |
| 4,426,970 | 1/1984 | Galis et al. | 123/365 |
| 4,459,957 | 7/1984 | Eheim | 123/373 |
| 4,782,804 | 11/1988 | Lehmann | 123/365 |
| 4,796,581 | 1/1989 | Brühmann | 123/373 |

FOREIGN PATENT DOCUMENTS 3641794 6/1987 Fed. Rep. of Germany .

*Primary Examiner*—E. Rollins Cross
*Assistant Examiner*—Thomas N. Moulis
*Attorney, Agent, or Firm*—Edwin E. Greigg; Ronald E. Greigg

[57] ABSTRACT

A speed governor for internal combustion engines, having a centrifugal speed transducer serving to govern the speed, acting counter to the force of governor springs, generating a speed-dependent adjusting travel of a governor sleeve, and equipped with flyweights, which transducer acts via the governor sleeve and a governor lever upon a fuel quantity adjusting device governor rod of the fuel injection pump. The governor sleeve comprises a first, inner drag member part and a second, outer drag member part, between which two drag springs are coaxially disposed, of which one drag spring is operative in only one direction of axial motion.

9 Claims, 1 Drawing Sheet

SPEED GOVERNOR FOR FUEL INJECTION PUMPS OF INTERNAL COMBUSTION ENGINES

BACKGROUND OF THE INVENTION

The invention is based on a speed governor for fuel injection pumps of internal combustion engines.

From German Patent Application 36 41 794, a speed governor is already known in which a centrifugal adjuster converts an adjusting force, which corresponds to the rpm of the engine to be supplied, into an adjusting motion of a governor sleeve that via a governor lever connects the centrifugal adjuster to a fuel injection quantity adjusting device of a fuel injection pump. The flyweights act via bell cranks on the inner drag member part, which comprises a bolt and a drag spring acting axially upon it, the inner drag member part being guided in the governor sleeve which forms the outer drag member part; on the circumference of the governor sleeve, the governor lever engages an annular groove therein via a slide block.

The governor sleeve then performs not only the transmission of the adjusting motion from the centrifugal adjuster via the governor lever to the fuel injection quantity adjusting device but also performs an adaptation of the fuel supply quantity to the requirements of the engine to be supplied and stores the motion of the outer drag member part relative to the inner drag member part, such as it may occur for instance during engine braking.

During the adaptation process, in which the governor sleeve is displaced in the direction of the fuel injection pump counter to the drag spring, while the inner drag member part is stationary, a short spring travel with high resistance is necessary. Contrarily, upon a travel-storing motion, in which the governor sleeve maintains its position and the inner drag member part is displaced by the flyweights in the direction of the fuel injection pump, an escape function of the drag spring that receives the entire adjusting travel is necessary.

These mutually contradictory tasks are achieved in the known fuel injection pump with a bidirectionally acting drag spring, and in a second exemplary embodiment with two series-connected and each unidirectionally acting drag springs; the space in the governor sleeve puts limits on optimal spring design, so that to increase the spring storing travel during the escape function, an additional travel storing member is necessary, disposed on the governor mechanism.

OBJECT AND SUMMARY OF THE INVENTION

The speed governor of the invention has an advantage over the prior art that while the space in the governor sleeve, which may be slight, stays the same, both a high spring stiffness necessary for the adaptation process and a long spring travel necessary for the travel storage function, with low spring stiffness, can be achieved.

By using parallel-drag springs disposed coaxially to one another, it is possible for the spring stiffness in the adaptation process to be increased, although the adjusting travel remains the same as in the known versions, or by varying the individual drag springs, for the restoring force to be overcome to be adapted optimally to the given requirements. Since one of these two drag springs, because of its pivotable connection to the bearing bolt of the inner drag member part, is operative in only one direction, asymmetrical adjusting travels and adjusting forces in the axial motion directions of the inner drag member part relative to the outer drag member part are possible. Thus the requirements for a long spring travel with a soft spring that receives the entire adjusting travel during the travel storing function, and a shorter, hard spring travel during the adaptation process can be met, without increasing the space required.

By varying the spring stiffness of the inner, unidirectional drag spring, by installation with and without prestressing or installation of the inner drag spring with axial play, it is advantageously also possible to achieve a frequently demanded kinked adaptation course of the characteristic curve of the pump.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
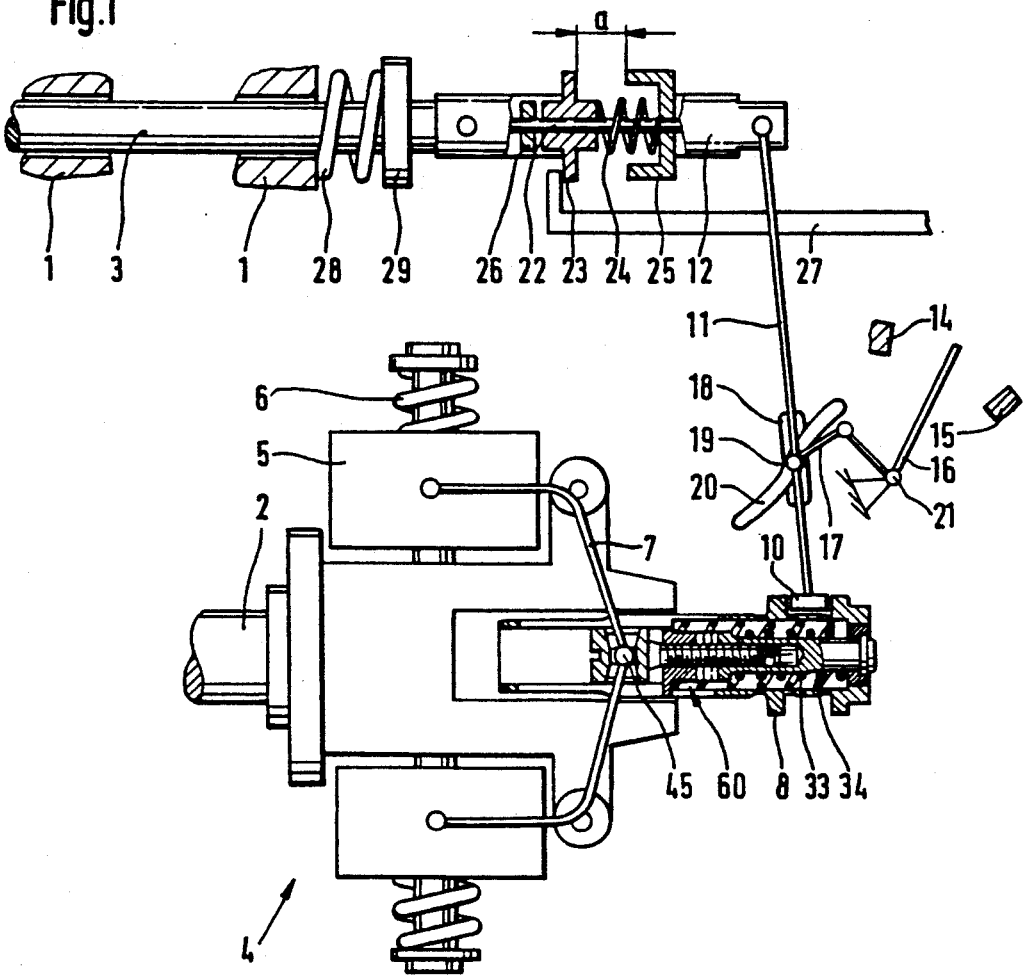
FIG. 1 is a simplified illustration of the speed governor of a fuel injection pump according to the invention.

In FIG. 1, the essential parts of the speed governor according to the invention, which cooperates with a fuel injection pump of an internal combustion engine, are shown in simplified form.

The speed governor is mounted on a housing 1 of a fuel injection pump, of which only a camshaft 2 and a longitudinally displaceably supported governor rod 3, acting as a fuel injection quantity adjusting device, are shown. The camshaft 2, driven at an rpm proportional to the engine, in turn drives the centrifugal speed transducer 4, which has two flyweights 5; counter to the force of the governor spring 6, the flyweights 5, under the influence of the centrifugal force arising upon rotation, actuate a governor sleeve 8, which forms a drag member, via two bell cranks 7. Only one of the governor springs 6 is shown. Typically, at least one idling spring and one final speed control spring, and sometimes an adaptation spring as well, typically engage each flyweight 5.

An annular groove 9 is disposed on the circumference of the governor sleeve 8 and engaged by a slide block 10 of a governor lever 11. The governor lever 11 connects the governor sleeve 8 to a strap 12 of the governor rod 3; by means of a one-armed adjusting lever 16, which is pivotable between a full load stop 14 and an idling stop 15 and is disposed on an adjusting shaft 21 supported in a manner structurally connected to the housing, and by means of a two-armed drop arm 17 that is also disposed firmly on the adjusting shaft 21 and connects the adjusting lever 16 to the governor lever 11, this governor lever 11 is pivotable in a slot 20 structurally connected to the housing, via a sliding block 19 that is guided in an oblong slot 18 on the governor lever 11. The strap 12, which forms a connection between the governor lever 11 and the governor rod 3, has in its interior a guide rod 22, disposed in the axial adjusting direction of the governor rod 3 and on which a spring plate 23 is guided in a longitudinally displaceable manner. This spring plate 23 is engaged, on the side remote from the fuel injection pump, by an adaptation spring 24, which on its other end is supported on a cup-shaped spring receptacle 25 that receives the guide rod 22 and is connected in a stationary manner to the strap 12. The axial motion of the spring plate 23 in the direction of the fuel injection pump is limited via a stop 26 on the guide rod 22.

In addition, a bent lever, forming an adjustable full load stop 27, engages the spring plate 23 of the strap 12 on the side toward the fuel injection pump. This full load stop 27 may be adjustable fixedly against the housing or may be adjustable as a function of engine operating parameters.

Under normal conditions, in other words at partial load of the engine, the spring plate 23 is retained in contact with the stop 26 by the adaptation spring 24. Not until the spring plate 23 rests on the full load stop 27 is the spring plate 23 lifted from the stop 26 upon further adjustment of the governor rod 3, counter to the adaptation spring 24, and then the adaptation spring 24 intervenes in the governing process.

To assure reliable guidance of the governor rod 3, a restoring spring 28 is disposed on the governor rod; this spring is located between the housing 1 and a shoulder 29 of the governor rod 3 and reinforces the restoring motion of the governor rod 3 in the idling direction and also assures that play is compensated for.

Figure 2:
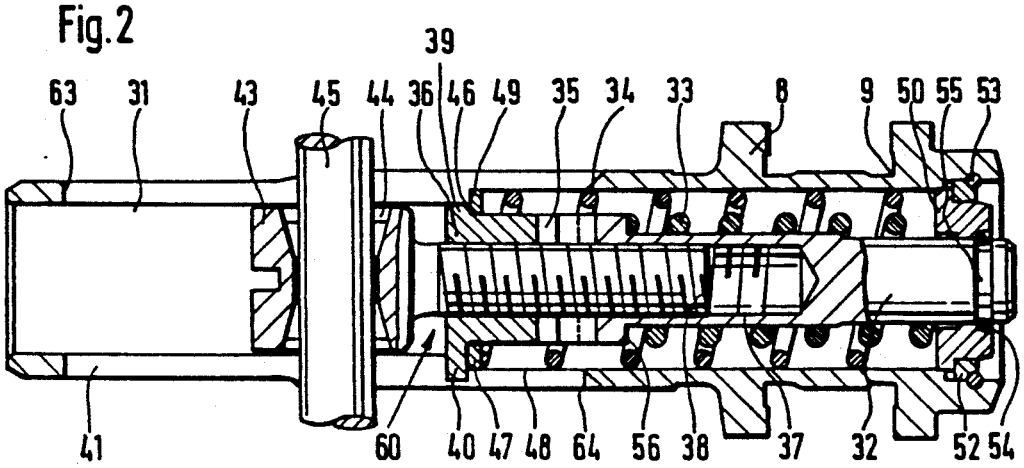
FIG. 2 is an enlarged view of the governor sleeve seen in longitudinal section, rotated by 90 ° from the view of FIG. 1.

The design according to the invention of the governor sleeve 8 that connects the centrifugal speed transducer 4 to the governor lever 11 is shown on a larger scale in FIG. 2. The governor sleeve 8 is equipped as an outer, second drag member part and has an axial bore 31, in which a bolt 32 is located along with an inner, second drag spring 33 disposed on the bolt and an outer, first drag spring 34 guided coaxially with the bolt in the bore 31.

The cylindrical bolt 32 has a set of teeth 35, on the face end toward the fuel injection pump, with which an adjoining cylindrical play compensation part 36, which is likewise toothed on the face end toward the bolt 32, meshes in a longitudinally displaceable manner. The bolt 32 and the play compensating part 36 have an internal thread 37, into which a sleeve position adjusting screw 38 is screwed and thus connects the bolt 32 to the play compensating part 36 with a defined, adjustable spacing relative to one another. The play compensating part 36, on its end remote from the bolt 32, has a collar 39 on its outer circumference, with which it is guided in the bore 31 of the governor sleeve 8.

To avert adjustment caused by independent rotation, a rib 40 is also disposed in the region of this collar 39, the rib running in an oblong slot 41 in the governor sleeve 8. The head 43 of the sleeve position adjusting screw 38 is likewise guided in the bore 31 and receives a connecting bolt 45, supported transversely to the axial adjustment direction and likewise guided in the oblong slot 41, the bolt 45 being received in a bore 44 that tapers conically on either side toward the axis of the sleeve position adjusting screw 38.

A ring 47, which is guided on the circumference of the play compensating part 36 and forms an abutment for the outer, first drag spring 34 rests on the face end 46 of the collar 39 on the play compensating part 36; this ring 47 is guided on its outer circumference in a widened portion 48 of the diameter of the bore 31, and it likewise comes to rest on the collar 49 produced by this widening. On the side away from the ring 47, the outer, first drag spring 34 is supported on a spring plate 50, which is guided on its outer circumference in the diameter widening 48 and slides via its inside diameter on the bolt 31.

The axial motion of the spring plate 50 on the side remote from the drag springs 33, 34 is limited by a support ring 52 in the diameter widening 48; this ring 52 is held against the bore 31 of the governor sleeve 8 by an outer snap ring 53, while the sliding motion on the bolt 32, in the direction remote from the drag springs 33, 34, is limited by a second snap ring 54 in a groove 55 of the bolt 32. The inner, second drag spring 33, which is guided on the outer circumference of the bolt 32, is supported on the spring plate 50 parallel to the outer, first drag spring 34; on the other wide, toward the play compensating part 36, the drag spring 33 rests on a support face 56 produced by a reduction in the bolt diameter. The inner, second drag spring 33, thus fastened in place, is accordingly effective only upon a motion of the bolt 32 in the direction remote from the centrifugal speed transducer 4, when the governor sleeve 8 is stationary, while the outer, first drag spring 34 is operative in both adjusting directions of the bolt 32.

To limit the axial adjusting travel of the first drag member part 60, comprising the bolt 32, the play compensating part 36 and the sleeve position adjusting screw 38, whose head 43 is engaged by the connection bolt 45 that connects the bell cranks 7 of the flyweights 5 to the first drag member part 60, and the second drag member part formed by the governor sleeve 8, two stops are formed by the terminal limitations of the oblong slots 41 of the governor sleeve 8. Of these, a first stop 63 limits the adjusting travel of the first drag member part 60 in the direction of the centrifugal speed transducer 4, by contact with the connecting bolt 45, and a second stop 64 limits the adjusting travel in the opposite direction by the contact of the rib 40. The speed governor described functions as follows. Upon actuation, the adjusting lever 16, shown in an intermediate position, displaces the sliding block 19 along the slot 20 via the drop arm 1. In this process, the sliding block 19 is displaced in the oblong slot 18 as well, so that the pivot point of the governor lever 11 and its location changes. However, if the governor sleeve 8, which represents a second pivot bearing, is stationary then the governor lever 11 is pivoted only about this pivot bearing, and in so doing displaces the strap 12 and moves the governor rod 3 into a new position; upon an adjusted position of the governor rod 3 in the direction of a high fuel supply quantity, the spring plate 23 is pressed against the full load stop 27 by the adaptation spring 24. The position shown for the flyweight 5 is that for a relatively low rpm. As soon as the rpm increases, for instance from a drop in the load on the engine, the flyweights 5 move outward, counter to the force of the governor springs 6, until an equilibrium is brought about between the speed-dictated centrifugal force of the flyweights 5 and the force of the governor springs 6. In this outward motion of the flyweights 5, the governor sleeve 8 is pulled to the left in the direction of the fuel pump via the bell cranks 7 and the connecting bolt 45, and in the process, via the annular groove 9, it carries the sliding block 10 along with it and thus pivots the governor lever 11 about the sliding block 19, so that the strap 12 and the governor rod 3 are adjusted in the opposite direction of the motion of the governor sleeve 8, in the direction of a smaller injection quantity. The sliding block 19 here serves as a pivot bearing for the governor lever 11.

In an idling position of the adjusting lever 16, in other words when it is in contact with the stop 15, the idling speed is governed via the governor springs 6 in the centrifugal speed transducer 4. Upon an ensuing load increase, the adjusting lever 16 is arbitrarily put in a specific position between the idling stop 15 and the full load stop 14 by the driver, and the governor rod 3 is correspondingly adjusted in the direction of an increased fuel quantity by a displacement of the governor lever 11; depending on the engine load, a medium speed is established as a result of the equilibrium between the speed-dependent force of the flyweights and the governor springs.

In full-load operation, in other words upon displacement of the adjusting lever 16 to the stop 14, the governor lever 11 is displaced in the slot 20 in the direction of the fuel injection pump, via the sliding block 19 that is displaceable in the slot 18. The governor lever 11 displaces the strap 12 in the direction of an increased fuel quantity, bypassing the adaptation spring 24, and the spring receptacle 25, after traveling the distance comes into contact with the spring plate 23, which on its other side rests on the adjustable full load stop 27, so that the strap 12 cannot be displaced farther in the direction of the fuel injection pump. Since the engine rpm that determines the location of the flyweights 5 cannot follow this adjusting lever motion until the governor rod 3 moves in the direction of an increased fuel supply quantity, the location of the flyweights 5 and thus the location of the first, inner drag member part 60 initially remains constant. Thus the governor lever 11 displaces the governor sleeve 8 in the direction of the fuel injection pump, counter to the force of the two drag springs 33, 34, and in so doing tenses these springs. As a result of the adjustment of the governor spring 3 in the direction of an increased fuel quantity, the engine speed rises, and the flyweights 5 are pressed outward counter to the force of the governor springs 6. The inner drag member 60 is displaced in the direction of the fuel injection pump via the bell cranks 7. This motion is supported by the tensed drag springs 33, 34, which begin to relax. As long as the force of the compressed drag springs 33, 34 suffices to keep the governor spring 11, which engages the outer circumference of the governor sleeve 8, in its position, the adaptation spring 24 on the strap 12 of the governor rod 3 remains bypassed as well. Upon a further increase in rpm, the inner, first drag member part 60 is displaced farther in the direction of the fuel injection pump, and the force of the tensed drag springs 33, 34 drops as a result, until such time as an equilibrium is attained between the force of the drag springs 33, 34 and the force of the tensed adaptation spring 24.

Upon a further increase in rpm and the associated drop in force of the drag springs 33, 34, the spring receptacle 25 lifts away from the spring plate 23 because of the now stronger force of the adaptation spring 24, and in so doing pivots the governor lever 11 about the sliding block 19 and pivots the governor rod 3, connected via the strap 12, in the direction of a smaller fuel supply quantity. With increasing engine speed, the first, inner drag member part 60 is displaced farther in the direction of the fuel injection pump, and the drag springs 33, 34 relax until they resume their normal position. The drag member 8, 60 now cooperates with the governor lever 11 again like a rigid connection; the adaptation spring 24 is likewise relaxed to its outset position, and the flyweights 5, counter to the force of the governor springs 6, determine the adjustment of the governor rod 3 as a function of the adjusting lever 16. Various adaptation functions can be realized by how the drag springs 33, 34 are prestressed; by installing the inner, second drag spring with axial play, a kinked adaptation course can also be obtained. If the situation arises where the engine speed is higher than the location of the adjusting lever 16 would indicate, then the flyweights 5 are displaced outward, but the governor sleeve 8, which is firmly fixed in its position by the governor lever 11, does not follow this motion in the direction of the fuel injection pump. The outer, first drag spring 34 now tenses and stores the motion of the inner, first drag member part 60. The inner, second drag spring 33 disposed on the first drag member part 60 remains inoperative, because its two abutments 50, 56 are disposed on the displaced drag member part 60, so that this spring 33 thus jointly carries out the axial relative motion of the first, inner drag member part 60 toward the governor sleeve 8. Via the outer, first drag spring 34, which is now the only one in operation, it is possible to achieve storage of the entire travel of the drag member part 60 in the governor sleeve 8, without impairing the adaptation function as a result. If the engine speed drops further, then the outer, first drag spring 34 relaxes, and the drag member 8, 60 continues to operate in the known manner. This travel storing function is necessary in order to avoid damage to the lever system at increasing speed (such as downhill travel of a vehicle driven by the engine to be supplied) and a constant governor rod position. It thus becomes possible to make an optimal adaptation of the adaptation and travel storing function of the governor sleeve 8 of the speed governor of the fuel injection pump to the demands made of the engine at a given time, without requiring additional installation space for additionally provided components.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A speed governor for fuel injection pumps of internal combustion engines, having a centrifugal speed transducer (4) with flyweights (5), which are adjustable counter to a governor spring (6) and are coupled to a governor lever (11) via a governor sleeve (8), which has a prestressed, first drag spring (34), the governor lever having a pivot shaft (19) that is adjustable by means of an adjusting lever (16) and being connected to a fuel injection quantity adjusting device (3), whose adjustment travel in a direction of increasing the fuel injection quantity is limited by a full load stop (27), a second drag spring (33) is disposed coaxially with the first drag spring (34), said second drag spring (33) is supported on a spring plate (50) shared with the first drag spring (34), said spring plate is connected to a drag member part (60) coupled to the flyweights (5) and is held by the prestressed, first drag spring (34) in contact with a first stop (52) on said governor sleeve (8) connected to the governor lever (11), said governor sleeve (8) has a support face (49), on which the first drag spring (34) is supported on its one end, and wherein between the full load stop (27) and the fuel injection quantity adjusting device (3), a spring plate (23) is provided that is displaceable between second and third stops (25, 26), between which spring plate and the fuel injection quantity adjusting device (3) a compression spring (24) is fastened, said compression spring acts upon the spring plate (23) in a direction of the full load stop (27), the first and second drag springs (33, 34) are disposed such that upon an adjustment of the governor sleeve (8) and the member part (60) relative to one another in the adjusting direction of the governor lever pivot point on the governor sleeve (8) to the flyweights (5), both drag springs (33, 34) are operative, and in a contrary adjustment of the governor sleeve (8) and the drag member part (60), only one of the drag springs (33, 34) is operative.

2. A speed governor as defined by claim 1, in which the second drag spring (33) engages the same side of the spring plate (50), and on the drag member part (60) a support face (56) of the second drag spring (33) is provided, against which the second drag spring (33) is made to rest, at least after a predetermined idle travel.

3. A speed governor as defined by claim 1, in which the first drag spring (34) is supported via a ring (47) on a collar (49), and the ring (47) is lifted away from the support face of the collar (49) by a coupling face (46) on the drag member part (60), and the spring plate (50) is displaceable on a bolt part (32) of the drag member part (60), which has a stop (54) for the spring plate (50) on the side of the spring plate (50) remote from the drag springs (33, 34).

4. A speed governor as defined by claim 2, in which the first drag spring (34) is supported via a ring (47) on a collar (49), and the ring (47) is lifted away from the support face of the collar (49) by a coupling face (46) on the drag member part (60), and the spring plate (50) is displaceable on a bolt part (32) of the drag member part (60), which has a stop (54) for the spring plate (50) on the side of the spring plate (50) remote from the drag springs (33, 34).

5. A speed governor as defined by claim 1, in which the second drag spring (33) is guided with axial play from the support face (56) on the bolt (32) and acts unidirectionally.

6. A speed governor as defined by claim 2, in which the second drag spring (33) is guided with axial play from the support face (56) on the bolt (32) and acts unidirectionally.

7. A speed governor as defined by claim 3, in which the second drag spring (33) is guided with axial play from the support face (56) on the bolt (32) and acts unidirectionally.

8. A speed governor as defined by claim 4, in which the second drag spring (33) is guided with axial play from the support face (56) on the bolt (32) and acts unidirectionally.

9. A speed governor as defined by claim 1, in which the drag member part (60) comprises a bolt (32) and a play compensating part (36), which on their face ends toward one another are longitudinally displaceably joined together via teeth (35), and into which parts, via an internal thread (37), an adjusting screw (38) is threaded that defines a spacing between them and via whose head the flyweights (5) are adjoined to the drag member part (8, 60).

* * * * *